US005941781A

United States Patent [19]

Sessions

[11] Patent Number: 5,941,781

[45] **Date of Patent: *Aug. 24, 1999**

[54] GOLF PUTTER SHAFT ATTACHMENT

[75] Inventor: Sammy Glenn Sessions, San Marcus, Calif.

[73] Assignee: Acushnet Company, Del.

[ * ] Notice: This patent is subject to a terminal disclaimer.

[21] Appl. No.: 09/034,903

[22] Filed: Mar. 4, 1998

Related U.S. Application Data

[63] Continuation-in-part of application No. 08/640,052, Apr. 30, 1996, Pat. No. 5,820,482.

[51] Int. Cl.[6] ..... A63B 53/02

[52] U.S. Cl. ..... 473/305; 473/312; 473/313

[58] Field of Search ..... 473/305, 306, 473/307, 308, 309, 310, 311, 312, 313, 314, 315, 324

[56] References Cited

U.S. PATENT DOCUMENTS

| | | |
|---|---|---|
| 1,589,707 | 6/1926 | Kraeuter . |
| 1,690,266 | 11/1928 | Barrett . |
| 1,930,204 | 10/1933 | Judd . |
| 2,146,321 | 2/1939 | Wettlaufer . |
| 3,170,691 | 2/1965 | Pritchard . |
| 3,394,745 | 7/1968 | Kuchins . |
| 3,572,709 | 3/1971 | Risher . |
| 3,640,534 | 2/1972 | Mills . |
| 3,759,517 | 9/1973 | Mills . |
| 4,832,340 | 5/1989 | Pickering . |
| 5,039,098 | 8/1991 | Pelz . |
| 5,042,806 | 8/1991 | Helmstetter . |
| 5,137,275 | 8/1992 | Nelson . |
| 5,275,409 | 1/1994 | Currie . |
| 5,388,827 | 2/1995 | Reynolds, Jr. . |
| 5,439,218 | 8/1995 | Gondeck . |
| 5,454,563 | 10/1995 | Nagamoto et al. . |
| 5,820,482 | 10/1998 | Sessions ..... 473/305 |

FOREIGN PATENT DOCUMENTS

| | | |
|---|---|---|
| 87/04634 | 8/1987 | WIPO . |

*Primary Examiner*—Sebastiano Passaniti
*Attorney, Agent, or Firm*—Pennie & Edmonds LLP

[57] ABSTRACT

The present invention is a putter comprising: a putter head having a striking face, a crown surface and a bore in the crown surface, a connection pin secured to the bore of the putter head through a mechanical connection, a shaft adhered to the putter bore and the connection pin and further including structure to increase the adhesive bond between the bore, shaft and the connection pin. Preferably, the bore is comprised of a first section and a second section and the shaft is adhered to the first section of the bore and the connection pin is secured to the second section of the bore, and has an increased surface area to strengthen the adhesive bond between the shaft and the connection pin. Preferably, the second section of the bore and the shaft also have an increased surface area to strengthen the adhesive bond between the bore and the shaft and the shaft and the connection pin.

32 Claims, 15 Drawing Sheets

GOLF PUTTER SHAFT ATTACHMENT

This application is a continuation-in-part of U.S. patent application Ser. No. 08/640,052 filed on Apr. 30, 1996 now U.S. Pat. No. 5,820,482.

TECHNICAL FIELD OF THE INVENTION

The invention relates generally to a golf putter having a shaft-in-bore attachment. More particularly, the invention relates to a method of attaching a shaft to a putter head wherein the shaft is inserted into a bore in the putter head and adhered thereto using an increased surface area in combination with the adhesive bond to achieve a high integrity adhesive bond.

BACKGROUND OF THE INVENTION

Golf putters with shaft-in-bore attachments are well known in the art. Most mallet putters are assembled using the shaft-in-bore attachment. As shown in FIG. 2, the putter head is provided with a bore hole for receiving a shaft. The shaft is inserted into the bore and adhered to the putter head, creating a bond between the outer surface of the shaft and the bore. However, this type of attachment does not provide a secure attachment.

SUMMARY OF THE INVENTION

It is an object of the present invention to provide a more secure attachment for the putter shaft to the putter bore in a shaft-in-bore attachment. It is also an objective of the present invention to provide a secure attachment between the shaft and the putter head that is inexpensive and easy to manufacture and assemble.

A more secure attachment is needed for putters using mallet heads and/or bent shafts. With these types of putters the putter head separates more easily from the shaft if there is not enough surface area for proper attachment. A mallet head does not have enough adjacent surface area to make a proper connection between the mallet head and the shaft. Further, bent shafts often separate easily from the putter head. Thus, a more secure attachment is desired.

Further, a more secure attachment is needed to counteract the forces that act on the putter when used in play. In simplified terms, as the putter strikes the golf ball a force acts on the face of the putter. Because the shaft is attached to one end of the putter head a moment is created resulting in a torque on the connection between the shaft and the putter head. The force reduces the integrity of the bond attaching the shaft to the putter head.

The wear on the bond between the shaft and the putter head affects the putter's performance during play. The force can cause premature wear of the bond, thereby shortening the life of the club. In extreme cases, wear of the bond causes the putter head to detach from the putter shaft. Further, this wear disrupts the game because the bond between the shaft and the putter head may weaken and cause the putter head to move in relation to the shaft. This is undesirable during play. Thus, it is an object of the present invention to provide a more secure bond between the shaft and the putter head.

The present invention is a putter comprising: a putter head having a putter face, a crown surface and a bore in the crown surface, a connection pin secured to the bore of the putter head through a mechanical connection, a shaft adhered to both the putter bore and the connection pin, and a means for increasing the adhesive bond between the shaft and the connection pin and the shaft and the bore.

Preferably, the bore is comprised of a first section and a second section and the shaft is adhered to the first section of the bore and the connection pin is secured to the second section of the bore. The putter shaft end is tubular and has an inner diameter and an outer diameter. The first section of the bore preferably has a first diameter approximately the same as the outer diameter of the shaft. The diameter of the connection pin is approximately equal to the inner diameter of the shaft such that the shaft can be adhered thereto. It is also preferred that the connection pin has a length greater than the bore depth such that the connection pin extends from the putter head. Most preferably, the connection pin length is greater than two times the depth of the bore. Moreover, at least a portion of the connection pin that is adhered to the shaft is serrated for a strong bond. The serrated connection pin creates a stronger bond with the shaft because of the increased surface area. The bond can then better withstand forces acting on the bond.

Preferably, the increased surface area is achieved through serrations on either the inner surface of the shaft, the outer surface of the connection pin or both. Moreover, the securement of the shaft to the putter head may be strengthened further by increasing the surface area of either the inner surface of the bore or the outer surface of the shaft adjacent to the bore. It is also preferred that an adhesive is used to adhere the shaft to the connection pin and putter head.

In a first embodiment, the mechanical connection between the connection pin and the putter head is a threaded connection. In another embodiment, the putter is further comprised of a securement pin that extends through the putter head and the connection pin to form the mechanical connection. Preferably, the securement pin also extends through the shaft to provide a second mechanical connection between the shaft and the putter head. In another embodiment of the present invention, the mechanical connection is a press fit connection that is formed by swaging the connection pin into the bore. In yet still another embodiment, the connection pin is welded to the bore and the mechanical connection is the weld created thereby.

DESCRIPTION OF THE PREFERRED EMBODIMENT

Figure 1:
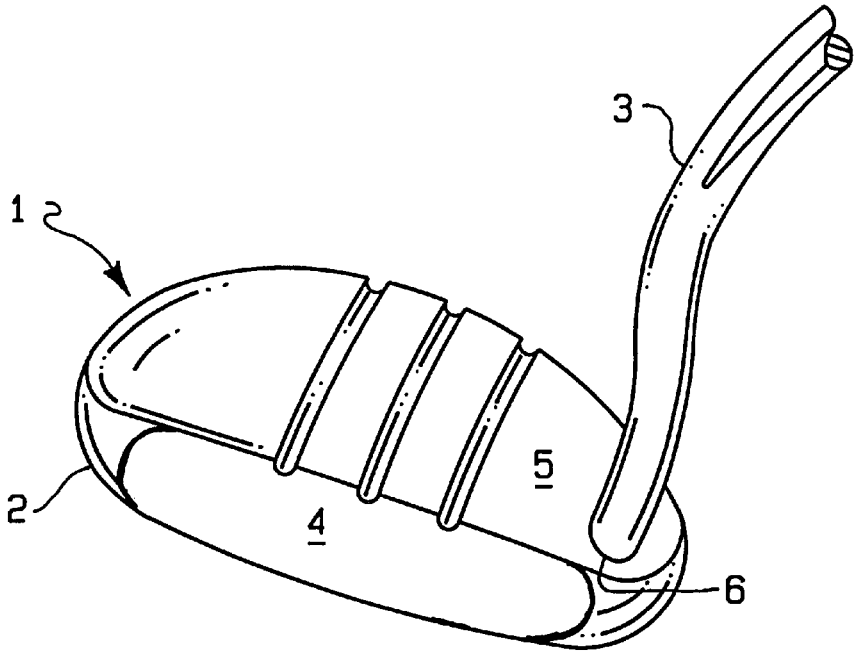
FIG. 1 is a perspective view of a golf putter head and shaft according to the present invention.

Referring to FIG. 1, a golf putter 1 according to the present invention includes a putter head 2, a shaft 3 and a grip (not shown). The putter head 2 is comprised of a putter face 4, a crown (or top) surface 5 and a bore 6 in the crown surface 5 for receiving the shaft 3. The shaft 3 is secured to the putter head 2 via an adhesive bond described in more detail below.

Figure 2:
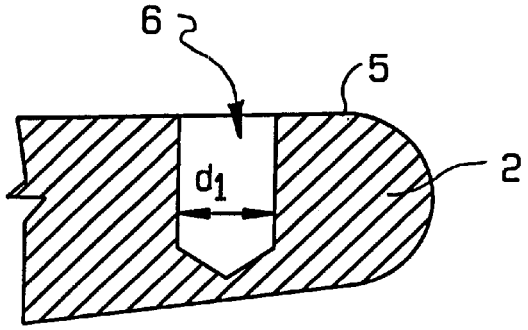
FIG. 2 (Prior Art)
FIG. 2 is a cross-section of a portion of a prior art putter head having a bore for receiving a shaft.
Figure 3:
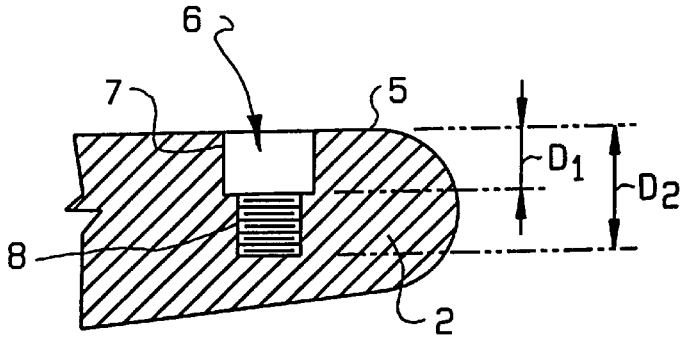
FIG. 3 is a cross-section of a portion of the putter head according to the present invention.
Figure 4:
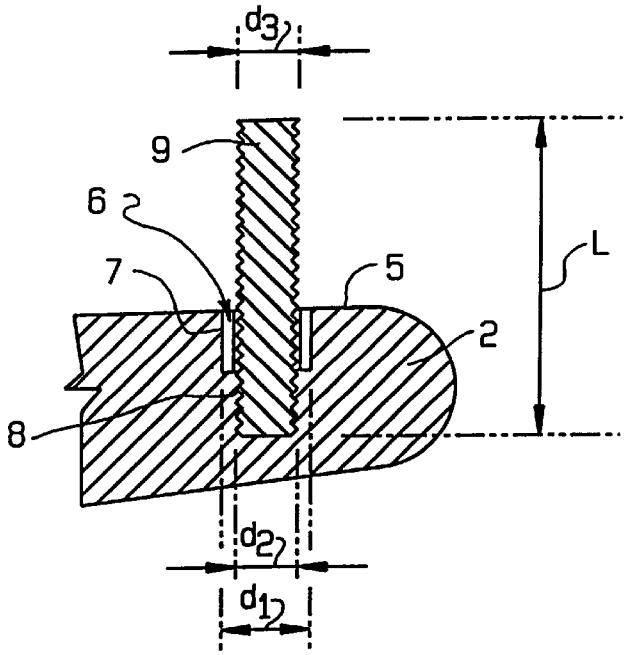
FIG. 4 is a cross-section of a portion of the putter head and connection pin according to the present invention.

Referring to FIG. 2, a cross section of a portion of a putter head 2 according to the prior art is shown. The prior art putter head 2 includes a crown surface 5 and a bore 6 in the crown surface 5. Typically, the bore 6 has a single diameter d1 which is substantially the same as the outside diameter of the putter shaft, i.e., the typical bore 6 is drilled to have a diameter d1 equal to 0.36 inches for a putter shaft having an outer diameter of about 0.36 inches. The shaft 3 is typically tip ground to reduce the outside diameter by about 0.005 inches and to roughen up the bonding surface. To bond the shaft 3 to the putter head 2, an adhesive, such as epoxy, is placed inside the bore 6 and the shaft is inserted therein such that the outer surface of the shaft 3 is adhered to the bore 6. Thus, the bond strength is dependent upon the adhesive strength and the bonding area.

Referring now to FIGS. 3–6, the putter 1 of the present invention is comprised of a putter head 2 which includes a bore 6 having two sections 7 and 8. The first section 7 has a diameter d1 which is substantially the same as the outer diameter OD of the shaft 3, generally about 0.36 inches, and extends into the putter head 2 from the crown surface 5 to a depth of D1. The second section 8 of bore 6 has a diameter d2 which is less than d1 and extends further into the putter head from the bottom end of the first section 7 to a depth D2 from the crown surface 5. The diameter of the second section d2 is approximately equal to or less than the inner diameter ID of the putter shaft 3. For a putter shaft 3 having an inner diameter ID of 0.28 inches, the second portion 8 has a diameter d2 of about 0.25 inches.

The putter 1 is further comprised of a connection pin 9. The connection pin 9 is a member having an outer diameter d3 that is substantially the same as the second bore section diameter d2 and slightly less than the inner diameter ID of the putter shaft 3. For a shaft 3 having an ID equal to about 0.28 inches, the connection pin 9 has an outer diameter d3 of 0.25 inches. The connection pin 9 is preferably made of steel or aluminum for strength, but can be made of a high strength plastic for reduced weight.

The connection pin 9 is inserted into the second section 8 of bore 6 and secured thereto by a mechanical connection 11. Preferably, the connection pin 9 is a screw having serrations 10, the second bore section 8 is threaded and the mechanical connection 11 between the connection pin 9 and the second bore section 8 is a threaded connection. Since the mechanical connection 11 is substantially stronger than an adhesive bond, the force required to pull the connection pin 9 from the bore 6 is substantially greater than for an adhesive bond. Epoxy is preferably poured into the second bore section 8 before the connection pin 9 is threaded therein so that the threaded connection does not loosen with time and vibration.

As stated above, the second section 8 of the bore extends from the bottom of the first section 7 to a depth D2 from the top of the crown surface 5. The connection pin 9 has a length L that is greater than the depth D2 such that the connection pin 9 extends from the bore 6. Preferably, the length L is greater than twice the depth D2. More preferably, the depth D2 is about 0.5 inches and the connection pin is at least 1 inch long. Thus, the connection pin 9 extends from the top of the putter head 2 and provides substantially more surface for the shaft 3 to attach to.

Figure 5:
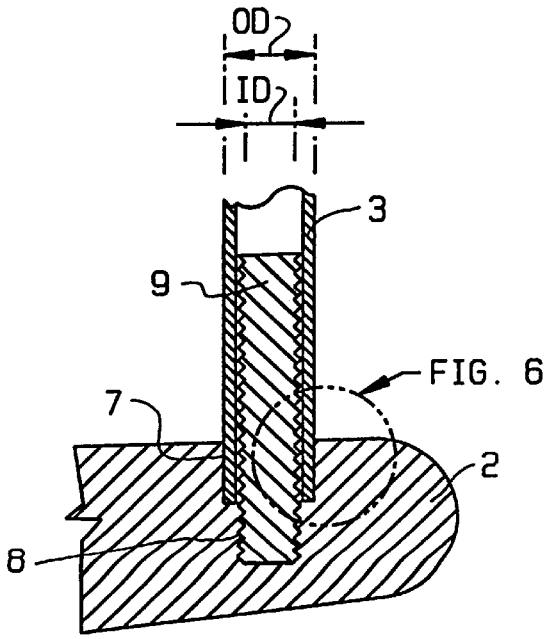
FIG. 5 is a cross-section of a portion of the putter head, connection pin and putter shaft according to the present invention.
Figure 6:
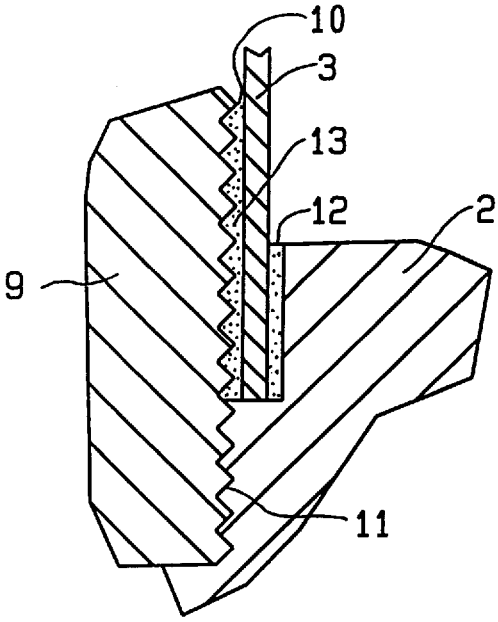
FIG. 6 is an enlargement of the circled portion of the putter head, connection pin and putter shaft in FIG. 5.

Referring to FIGS. 5 and 6, the shaft 3 is shown inside the first bore section 7 and circumscribed around a portion of the connection pin 9. The shaft 3 is bonded, preferably with an epoxy, to both the bore 6 and the connection pin 9. FIG. 6 shows the adhesive bond 12 between the outer surface of the shaft 3 and the inner surface of the bore 6 and the adhesive bond 13 between the inner surface of the shaft 3 and the outer surface of the connection pin 9. As stated above, the connection pin 9 preferably is a screw having serrations 10. This creates a strong mechanical connection 11 with the putter head 2 and substantially increases the strength of the adhesive bond 13 between the connection pin 9 and the shaft 3. Since the connection pin 9 is mechanically secured to the putter head 2, the force required to separate the shaft 3 from the putter head 2 is substantially increased.

Figure 7:
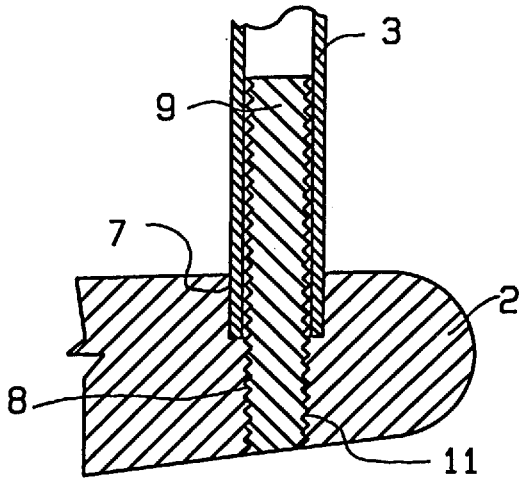
FIG. 7 is a cross-section of a portion of the putter head, connection pin and putter shaft of a second embodiment of the present invention.

FIG. 7 shows a second embodiment of a putter 1 according to the present invention that is very similar to the embodiment shown in FIGS. 3–6. The shaft 3 is adhered to both the putter head 2 and the connection pin 9. In this embodiment, however, the second portion 8 of the bore 6 extends through the putter head 2 to the sole 17. The mechanical connection 11 between the putter head 2 and the connection pin 9 is thus increased due to the increase in the threaded connection.

Figure 8:
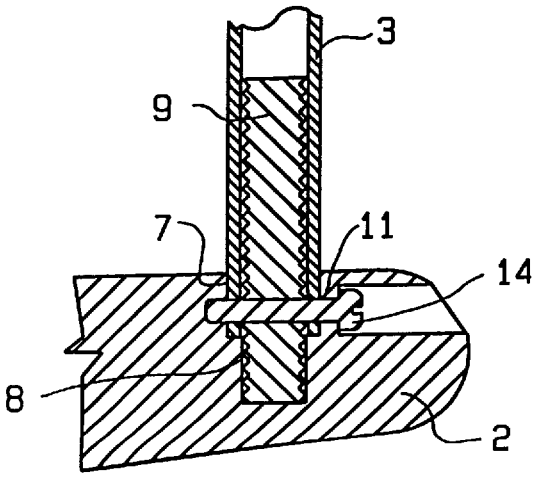
FIG. 8 is a cross-section of a portion of the putter head, connection pin and putter shaft of a third embodiment of the present invention.

Referring to FIG. 8, another embodiment of the present invention is shown wherein the connection pin 9 is secured to the putter head 2 via a securement pin 14. The securement pin 14 is preferably threaded into the putter head perpendicular to the connection pin 9 from either the putter face 4 or the back of the putter head 2 as shown. Preferably, the securement pin 14 is threaded through both the connection pin 9 and the shaft 3. Thus, a second mechanical connection is created between the shaft 3 and the putter head 2.

Figure 9:
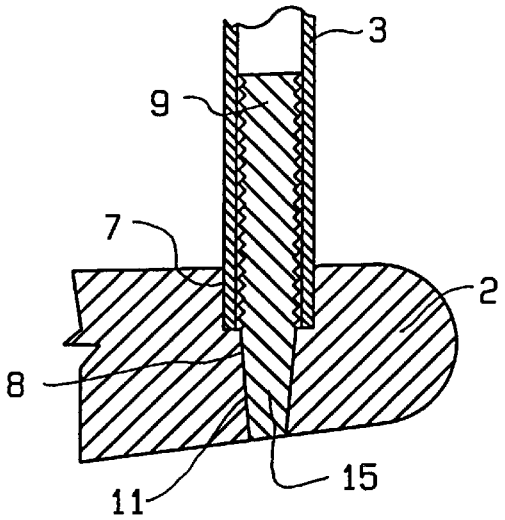
FIG. 9 is a cross-section of a portion of the putter head, connection pin and putter shaft of a fourth embodiment of the present invention.
Figure 10:
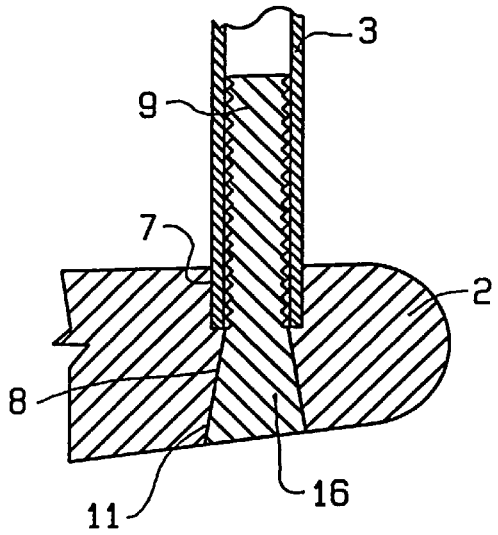
FIG. 10 is a cross-section of a portion of the putter head, connection pin and putter shaft of a fifth embodiment of the present invention.

In FIGS. 9 and 10 alternate embodiments of the present invention are shown wherein the connection pin 9 is secured to the putter head 2 through a press fit mechanical connection 11. The connection pin 9 is swaged into the second portion 8 of the bore 6 to provide a secure press fit. In FIG. 9, the connection pin 9 has a tapered end 15 for fitting into the second section of the bore 8 which has a corresponding configuration. The tapered end 15 decreases in diameter from a diameter that is substantially equal to the inner diameter of the shaft as it extends further into the putter. In this embodiment, the connection pin 9 is swaged into the putter head 2 from the crown surface 5. In FIG. 10, the connection pin 9 has a conical end 16 that increases in diameter from a diameter substantially equal to the inner diameter of the putter shaft as it extends further into the putter. In this embodiment, the connection pin 9 is inserted through the sole 17 and swaged into the putter head 2. In both of these embodiments, the connection pin 9 has a press fit mechanical connection 11 between the tapered end 15 or conical end 16 and the second section 8 of the bore 6.

Figure 11:
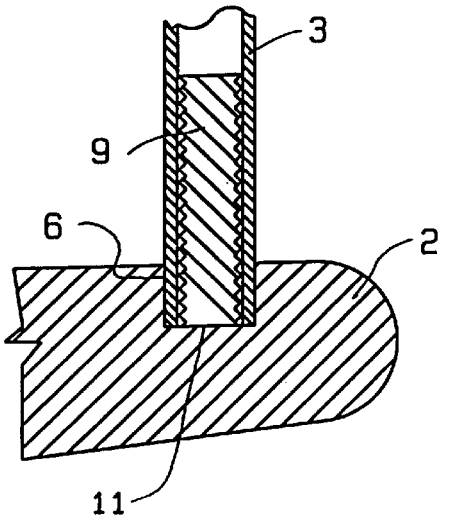
FIG. 11 is a cross-section of a portion of the putter head, connection pin and putter shaft of a sixth embodiment of the present invention.

Still yet another embodiment of the putter 1 according to the invention is shown in FIG. 11. In this embodiment, the mechanical connection 11 between the connection pin 9 and the putter head 2 is a weld, i.e., the connection pin 9 is welded to the bottom surface of the bore 6. Further, in any of these embodiments a hollow connection pin may be used to reduce the weight of the putter.

In all the above described embodiments an adhesive bond is used to secure the shaft 3 to the connection pin 9 and the bore 6. To provide an even more secure attachment the surface area adhesively bonded can be increased. It is possible to increase the bonded surface area of the connection pin 9, the bore 6, and/or the shaft 3. This is achieved by a variety of different methods. For example, increased bonded surface area can be obtained by threading, adding indentations or adding protrusions to the surface to be bonded.

Figure 12:
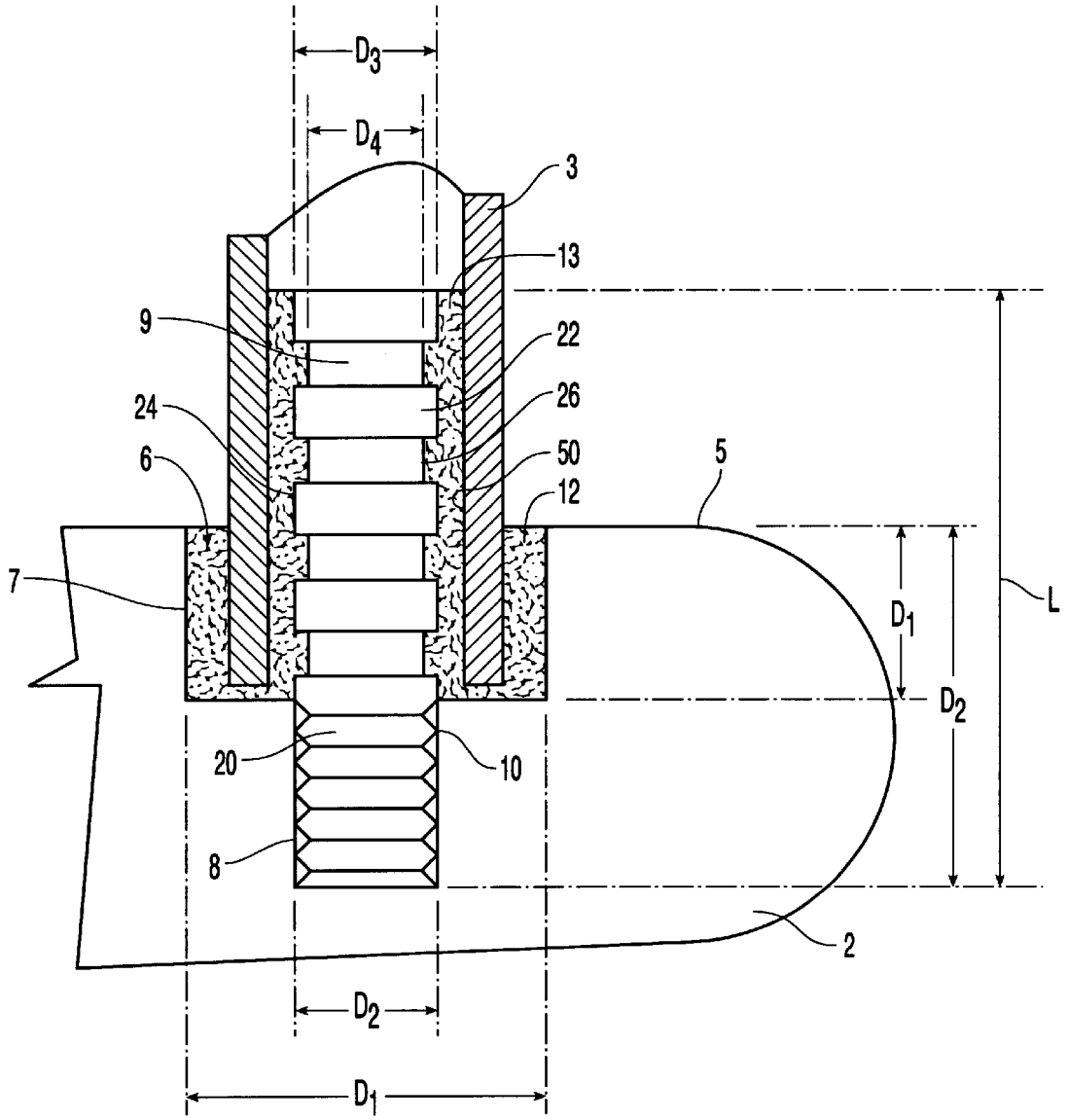
FIG. 12 is a cross-sectional view of a portion of the putter head, connection pin and a putter shaft of a seventh embodiment of the present invention.

There are many different embodiments of the present invention to increase the bonded surface area used in attaching the shaft 3 to the putter head 2. The bonded surface area is mainly increased by adding a non-linear contour to the desired surface of the connection pin, bore or shaft. One such embodiment is shown in FIG. 12. This embodiment of the present invention is similar to that previously described and shown in FIGS. 3–6, however the connection pin 9 has an increased bonded surface area.

In FIG. 12, the shaft 3 is shown inside the first bore section 7 and circumscribed around a portion of the connection pin 9. The shaft 3 is bonded, preferably with an epoxy, to both the wall surface of the bore 6 and the connection pin 9. The adhesive bond 12 between the outer surface of the shaft 3 and the inner surface of the bore 6 and the adhesive bond 13 between the inner surface of the shaft 3 and the outer surface of the connection pin 9 is shown in FIG. 12.

The upper portion 22 of the connection pin 9 that extends above the second section 8 of the bore 6 has an increased surface area. This is accomplished through a plurality of depressions 26 in the surface 24 of the upper portion 22 of the connection pin 9. The depressions 26 are made by cutting into the surface 24 of the connection pin 9. The diameter d4 of the portion of the connection pin 9 with the depressions 26 is slightly less than the diameter d3 of the connection pin 9. The width, depth, shape, placement and number of the depressions 26 combine to increase the surface area. The increased surface area on the connection pin 9 provides a more secure adhesive bond 13 between the outer surface 24 of the connection pin 9 and the inner surface 50 of the shaft 3.

A similar embodiment to the above discussed embodiment shown in FIG. 12, is shown in FIG. 5, except that the depressions 26 in the upper portion 22 of the connection pin 9 are serrations 10. The width and depth of the serrations 10 combine to increase the surface area. Preferably, the width of the serrations is at least equal to or greater than the depth of the serrations. Thus, the adhesive can flow more easily into the full depth of the serrations for a better adhesive bond.

The bonded surface area may be altered by varying the width and depth of the serrations 10. The serrations 10 are cut with a higher pitch so that there are a few deep serrations 10, or the serrations 10 are cut with a lower pitch resulting in many shallow serrations 10. Preferably the connection pin is also threaded with serrations in a direction to cause the putter head 2 to screw farther onto the connection pin 9 as the putter head 2 strikes a ball. Thus, the securement of the putter head 2 to the connection pin 9 is further increased by being threaded further onto the connection pin 9.

Figure 13:
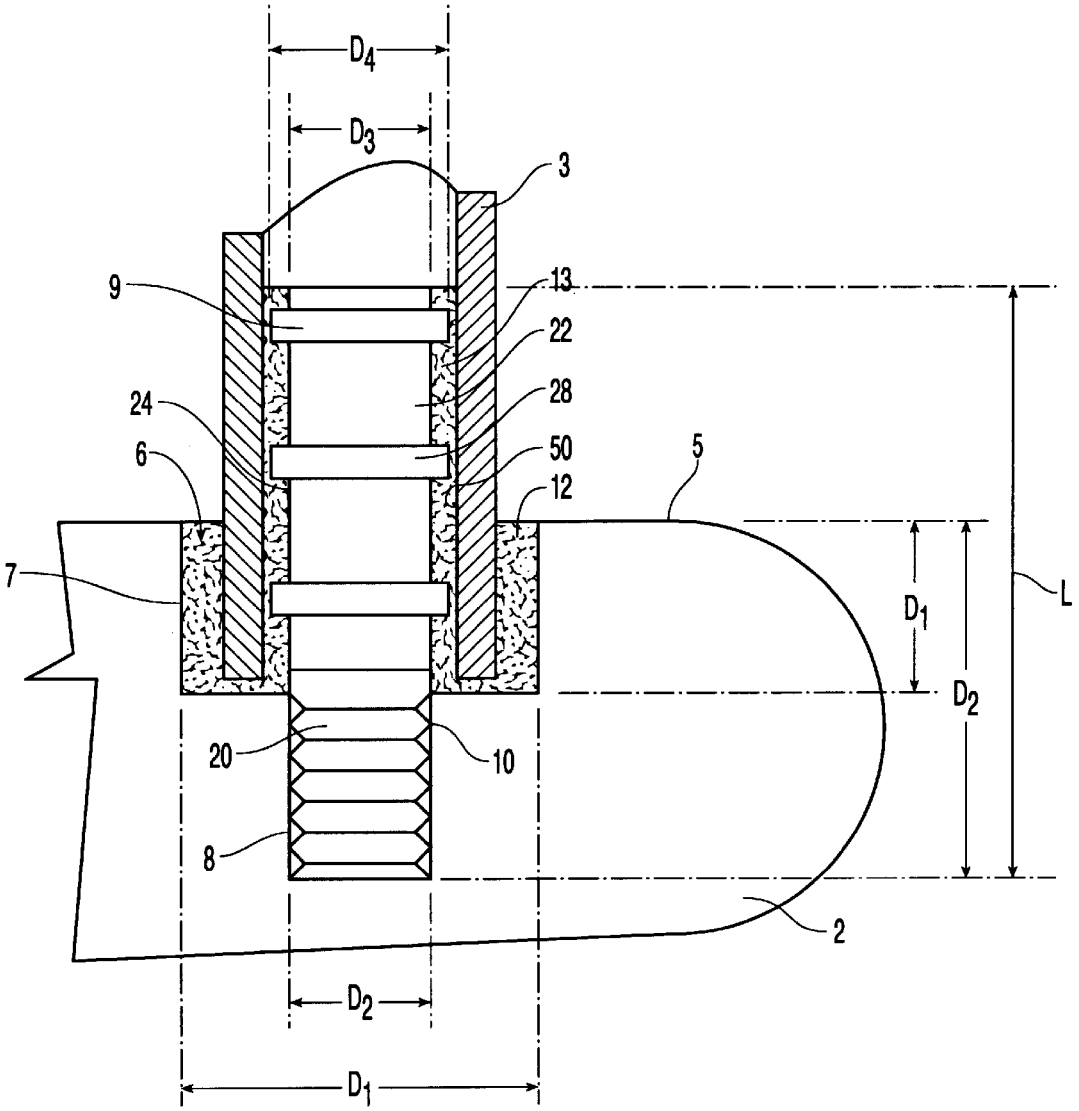
FIG. 13 is a cross-sectional view of a portion of the putter head, connection pin and a putter shaft of an eighth embodiment of the present invention.

Referring now to FIG. 13 another embodiment of the present invention is shown. This embodiment is similar to the disclosed embodiment shown in FIG. 12, however, the connection pin 9 has an increased surface area by the addition of protrusions 28 extending from the surface of the connection pin 9. The diameter of the lower portion of the connection pin d3 is slightly smaller than the diameter of the second section of the bore d2 and screws into the second section 8 of the bore 6. The diameter of the connection pin d3 is slightly smaller than the diameter of the connection pin including the protrusions d4. However, diameter of the connection pin including the protrusions d4 is still smaller than the ID of the shaft 3 so that the shaft 3 fits over and is adhesively secured onto the connection pin 9. The width, depth, shape, placement and number of the protrusions 28 combine to increase the surface area. The protrusions 28 provide an increased surface area for bonding that is different from that shown in FIG. 12.

Figure 14:
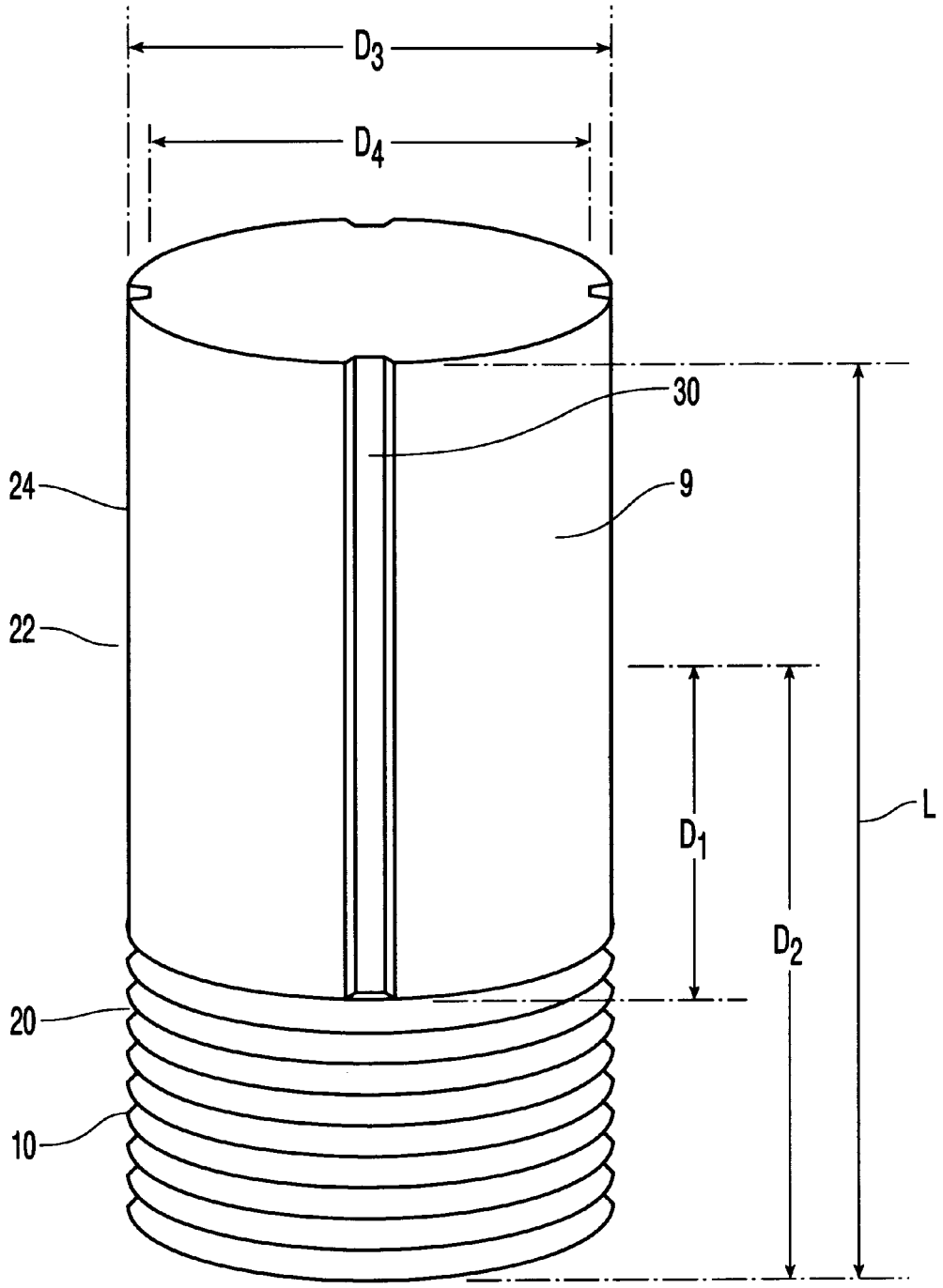
FIG. 14 is a perspective view of a connection pin of the present invention.

Referring now to FIG. 14, another embodiment for increasing the surface area of the connection pin is shown. The embodiment is similar to the above disclosed embodiment shown in FIG. 12, except that the connection pin uses a different method to increase the bonded surface area. In FIG. 14, plunge cuts make grooves 30 into the surface 24 of the upper portion 22 of the connection pin 9. The grooves 30 extend along the whole upper portion 22 of the connection pin 9 as shown in FIG. 14, or on only a portion thereof. Preferably, the grooves 30 extend along more than half the area bonded to the shaft 3. The grooves may be made in different patterns, horizontally, vertically, or diagonally. Moreover, the width, depth and number of grooves combine to increase the surface area. Further, by placing the connection pin 9 on its side and using different cutting tools, the cross-section of the grooves 30 may be shaped differently such as rectangles, triangles or half-circles. Thus, this embodiment provides yet another method of increasing the bonded area to achieve a more secure adhesive bond 12 that is different from that shown in FIG. 12.

Figure 15:
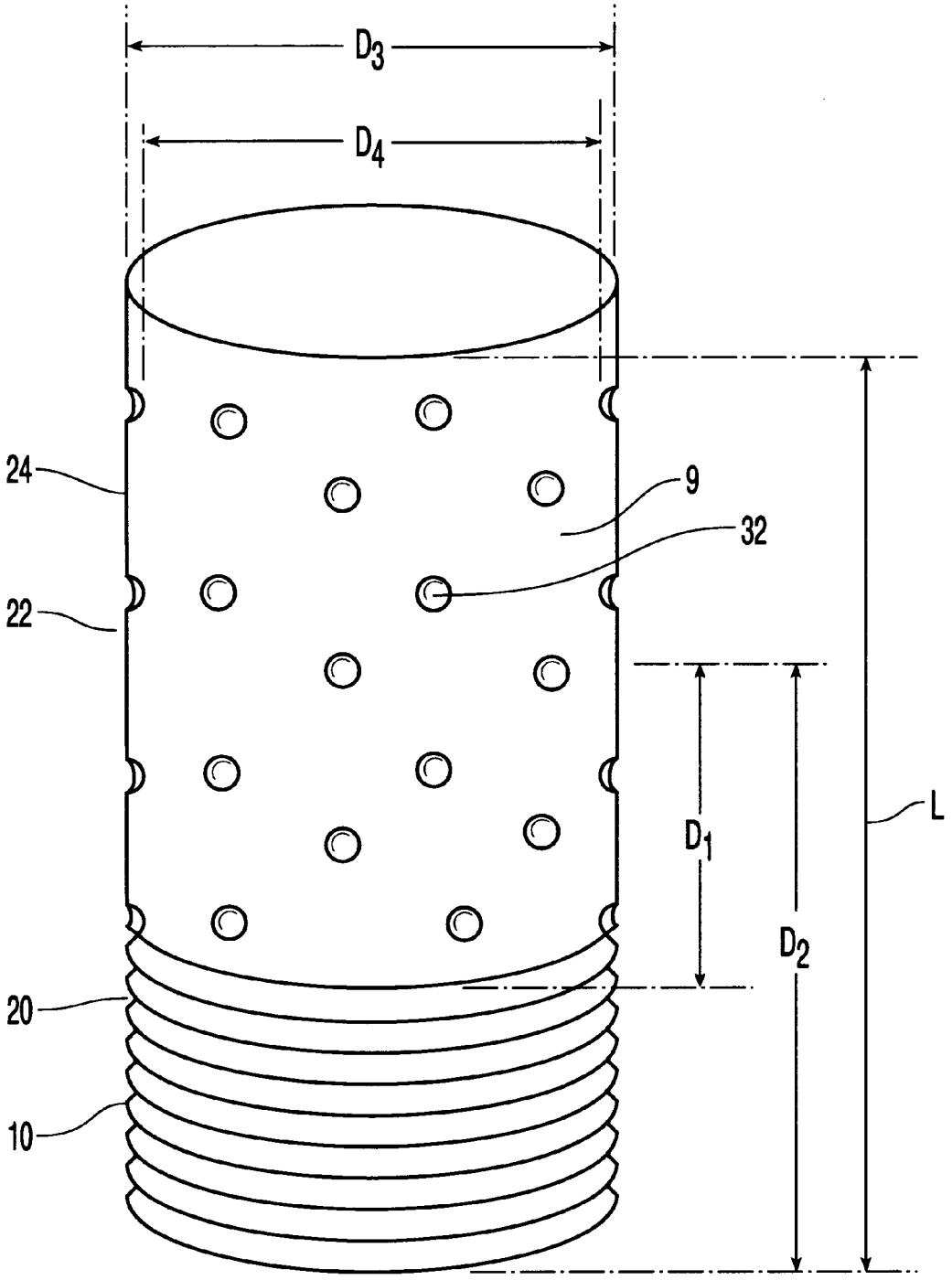
FIG. 15 is a perspective view of another connection pin of the present invention.

FIG. 15 shows yet another embodiment to increase the surface area on the connection pin 9. The connection pin 9 is used in a similar manner as the above disclosed embodiment shown in FIG. 12, except that the bonded surface area on connection pin 9 is increased by a different method. As shown in FIG. 15, the connection pin 9 includes dimples 32 on the surface 24 of the upper portion 22 of the connection pin 9. These dimples 32 are made by cutting a hemispherical shape into the surface of the connection pin 9 by using an end mill or by stamping. The size, depth, number and placement of the dimples result in different amounts of surface area. Moreover, different shapes may be used, such as cylindrical dimples 32 instead of hemi-spherical. The dimples 32 are placed on the upper portion 22 of the connection pin 9 as shown in FIG. 15, or any portion thereof. The dimples 32 provide an increased surface area for bonding that is different from that shown in FIG. 12.

Figure 16:
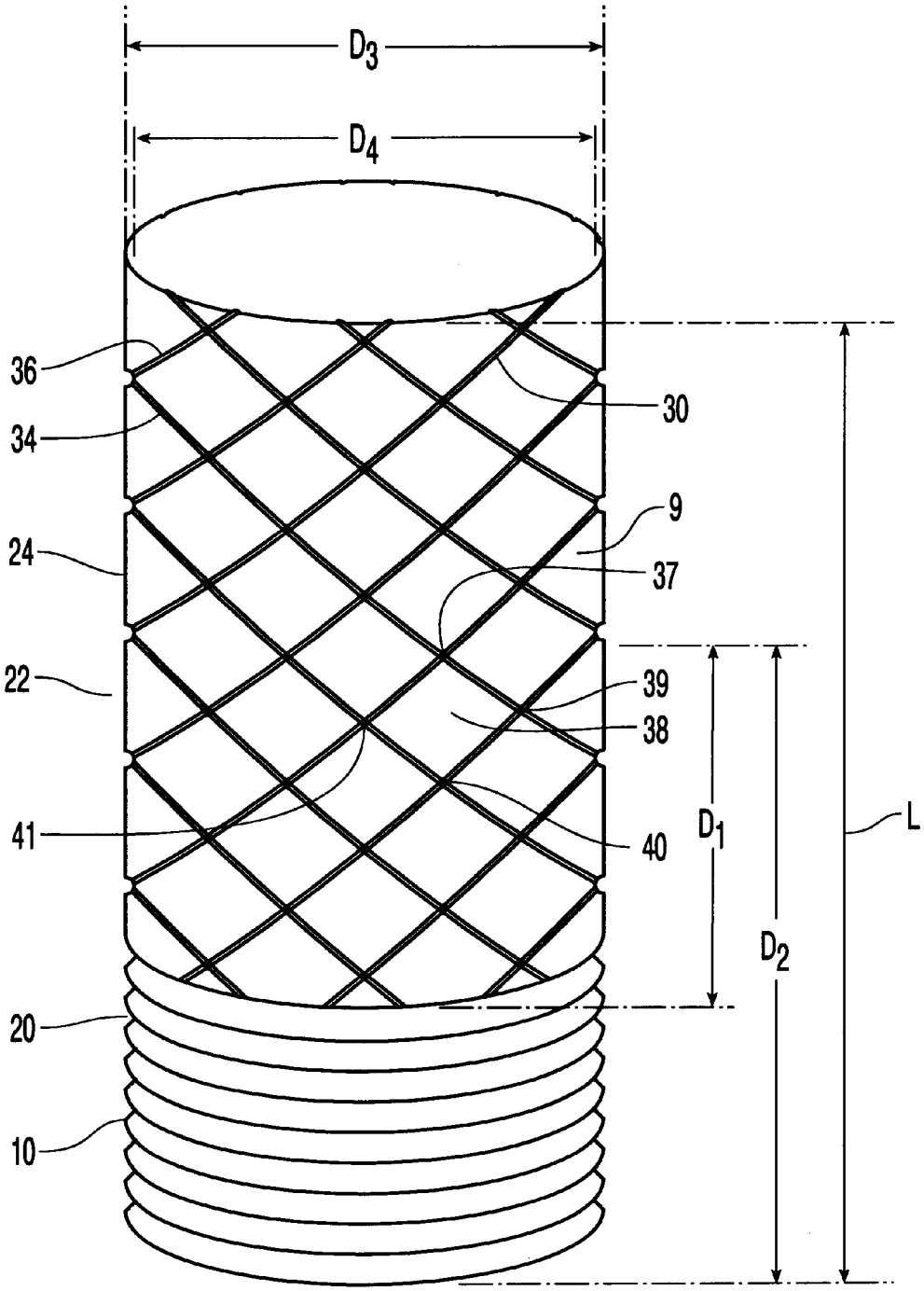
FIG. 16 is a perspective view of yet another connection pin of the present invention.

FIG. 16 shows yet another embodiment of increasing the surface area on the connection pin 9. The connection pin 9 is used in a similar manner as previously disclosed and shown in FIG. 12, except that the connection pin 9 has grooves 30 to increase the surface area for bonding. There are two sets 34, 36 of diagonal grooves 30 that are substantially perpendicular to one another, thus forming diamond shapes 38 between their intersections 37, 39, 40, 41. This pattern of grooves 30 may be made by knurling the surface 24 of the upper portion 22 of the connection pin 9. The grooves 30 provide an increased surface area to provide a high integrity adhesive bond 12 that is different from that shown in FIG.

Figure 17:
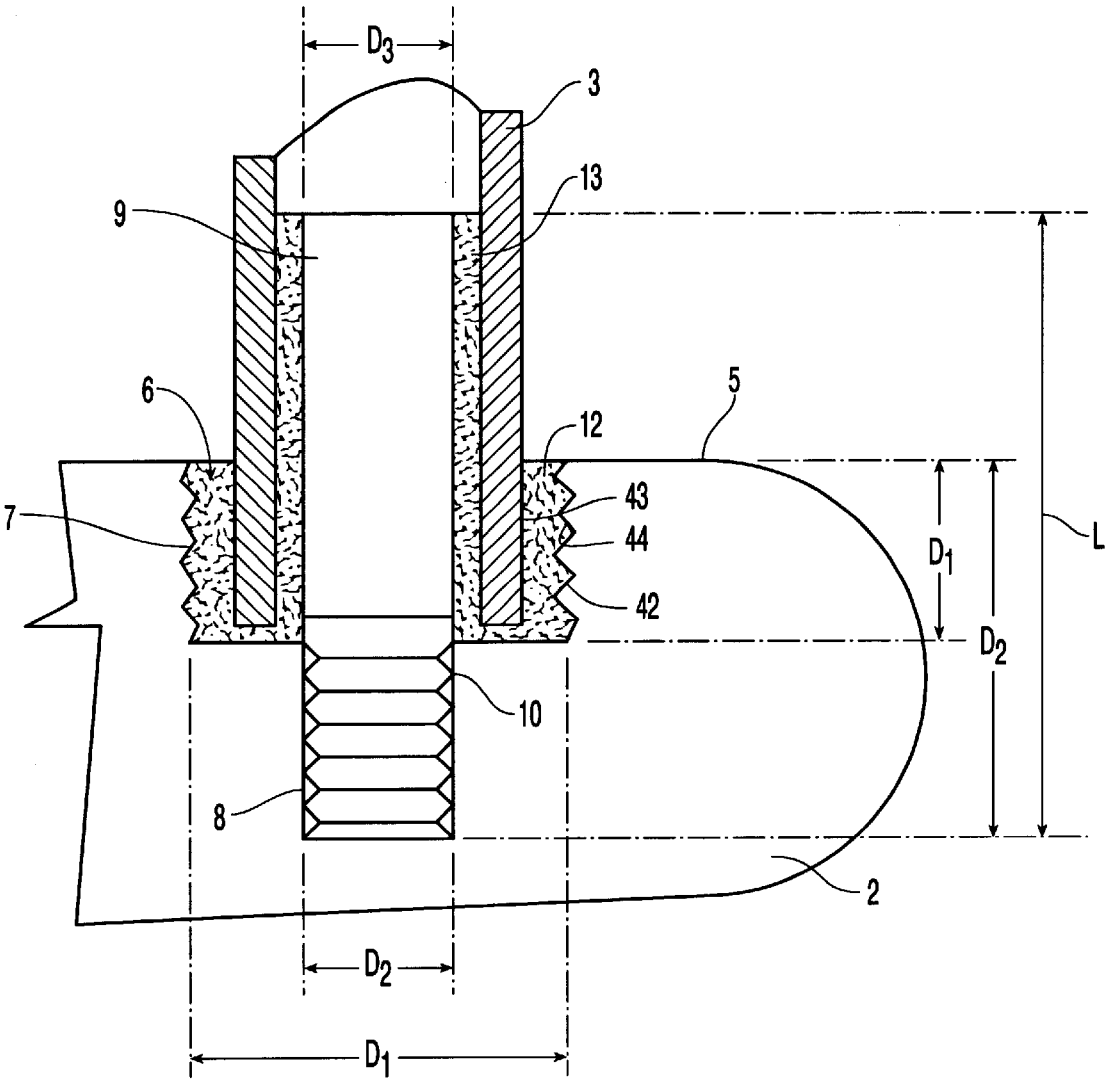
FIG. 17 is a cross-sectional view of a portion of the putter head, connection pin and putter shaft of a ninth embodiment of the present invention.

Another embodiment for securing a shaft 3 to a putter head 2 is shown in FIG. 17. This method is similar to the disclosed embodiment shown in FIG. 12, except that the increased surface area is on the first section 7 of the bore 6. As shown in FIG. 17, the surface area is increased by the use of serrations 42 on the inner surface 44 of the first section 7 of the bore 6. The serrations 42 are made by threading the bore 6. The depth and frequency of the serrations 42 combine to increase the surface area. Thus, a higher pitch is used to make fewer and deeper serrations 42 or a lower pitch is used to make more numerous and shallow serrations 42. The serrations 42 provide an increased bonded surface area resulting in a stronger adhesive bond 12 between the outer surface 43 of the shaft 3 and the inner surface 44 of the bore 6. Preferably, the bore 9,8, is threaded in a direction that causes the putter head 2 to screw farther onto the shaft 3 as the putter head 2 strikes a ball. Thus, the putter head 2 is even more securely attached to the shaft 3.

Figure 18:
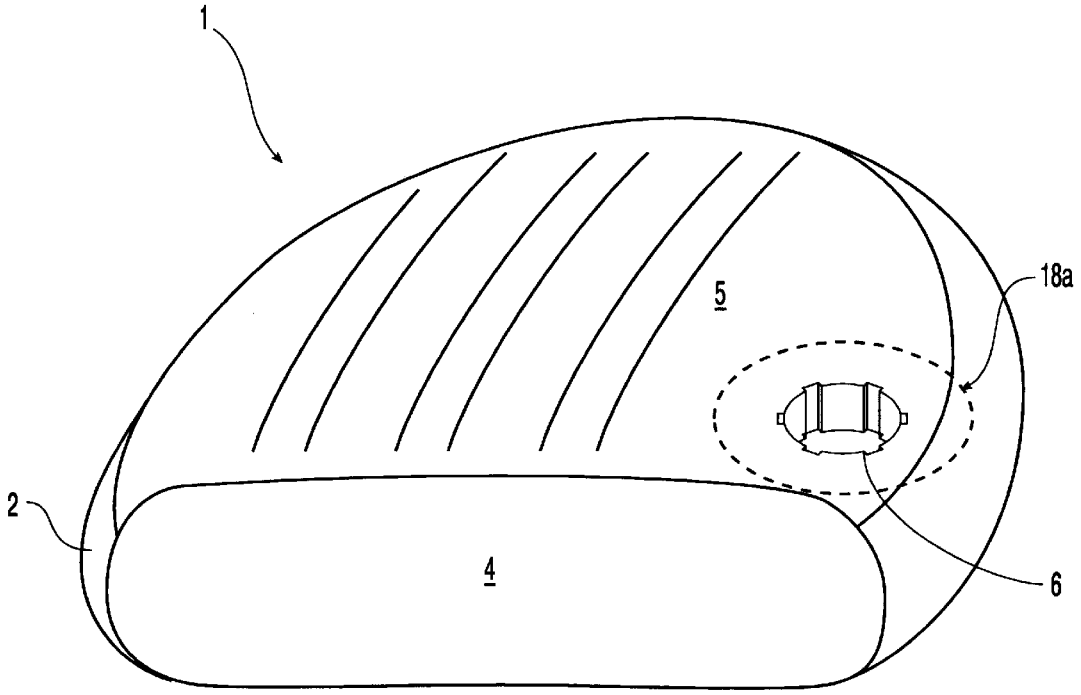
FIG. 18 is a perspective view of the putter showing the bore of another separate embodiment of the present invention.
Figure 18A:
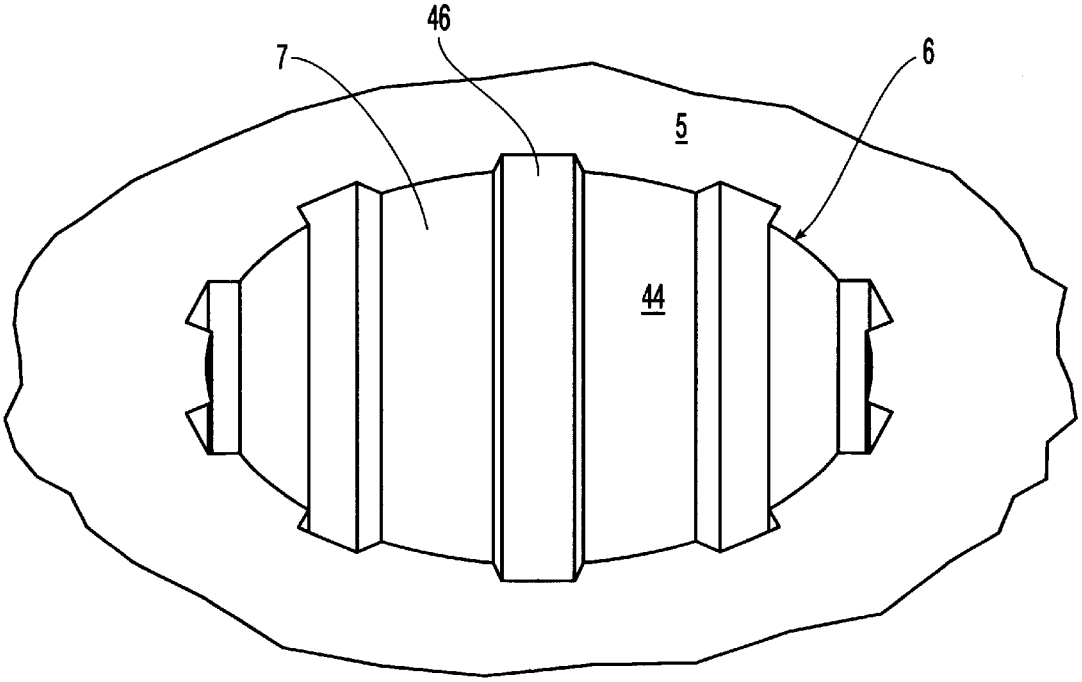
FIG. 18A is an enlargement of the circled portion of the putter head in FIG. 18 showing the bore.

FIGS. 18 and 18A show yet another embodiment for increasing the surface area of the first section 7 of the bore 6. This embodiment is similar to the disclosed embodiment shown in FIGS. 12 and 16, except that the bore 6 contains grooves 46 to increase the surface area on the first section 7 of the bore 6. These grooves 46 are formed by making a plunge cut into the inner surface 44 of the first section 7 of the bore 6. The width, depth, and number of grooves 46 combine to increase the surface area. The grooves 46, in a similar manner to the serrations 42 of FIG. 17, provide an increased bonded surface area resulting in a stronger adhesive bond 12 between the outer surface 43 of the shaft 3 and the inner surface 44 of the bore 6.

Figure 19:
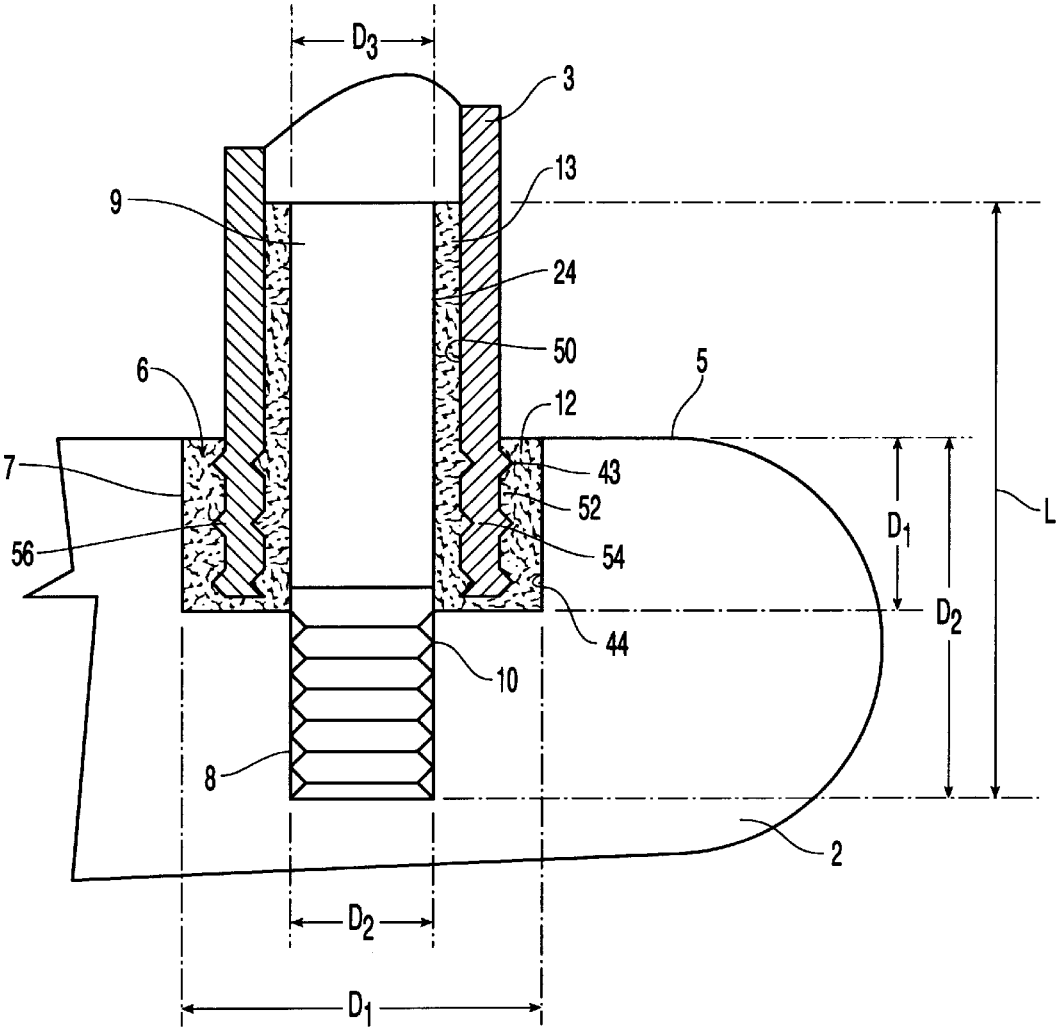
FIG. 19 is a cross-sectional view of a portion of the putter head, connection pin and putter shaft of an tenth embodiment of the present invention.

Referring now to FIG. 19, another embodiment for securing the shaft 3 to the putter head 2 is shown. This method is similar to the disclosed embodiment shown in FIG. 12, except that the increased surface area is located on the end 52 of the shaft 3 that is inserted into and adjacent the first section 7 of the bore 6. As shown in FIG. 19, the surface area is increased by crimping the end 52 of the shaft 3. The crimping causes a plurality of bends 54, 56 in the end 52 of the shaft 3. Because the shaft is bent, more of the shaft 3 is secured adjacent the first section 7 of the bore 6, thus resulting in more bonded surface area. Further, the surface area of the shaft 3 may be increased on either the inside surface 54 or the outside surface 56. Either method will assist in providing a higher integrity adhesive bond 12 between the outer surface 43 of the shaft 3 and the inner surface 44 of the bore 6, and the adhesive bond 13 between the inner surface 50 of the shaft 3 and the outer surface 24 of the connection pin 9.

Figure 20:
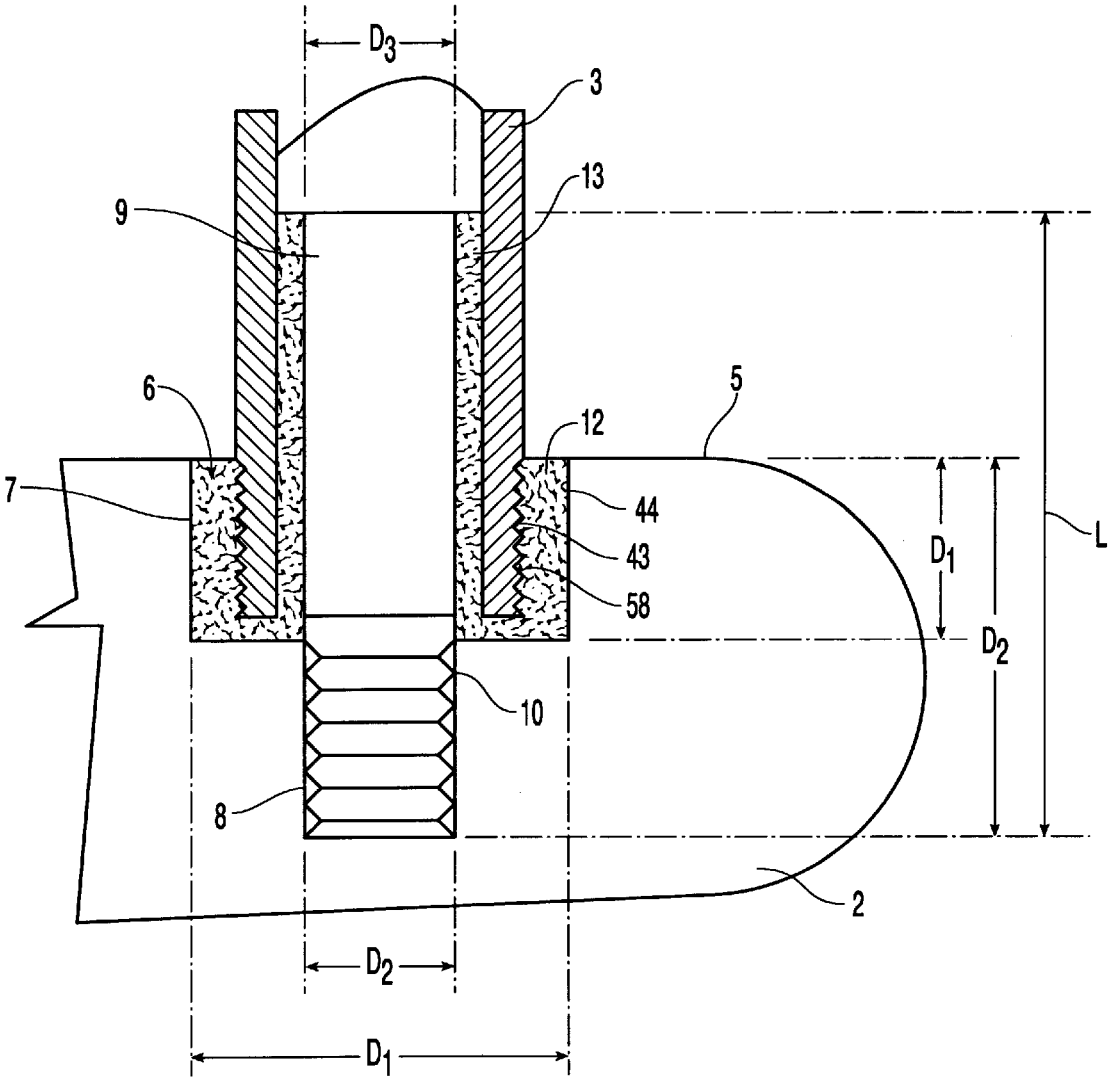
FIG. 20 is a cross-sectional view of a portion of the putter head, connection pin and putter shaft of a eleventh embodiment of the present invention.

Another embodiment to increase the surface area of the outer surface 43 of the shaft 3 is shown in FIG. 20. This method is used in a similar manner as disclosed and shown in FIGS. 12 and 19, except that the shaft 3 includes serrations 58 on the outside surface 43 of the shaft 3 for increasing the bonded surface area. As previously described, the width and depth of the serrations 58 combine to increase the surface area. Thus, there may be a few deep serrations 58 or many shallow serrations 58. This increased the surface area from the serrations 58 provides a stronger adhesive bond 12 between the outer surface 43 of the shaft 3 and the inner surface 44 of the bore 6.

Figure 21:
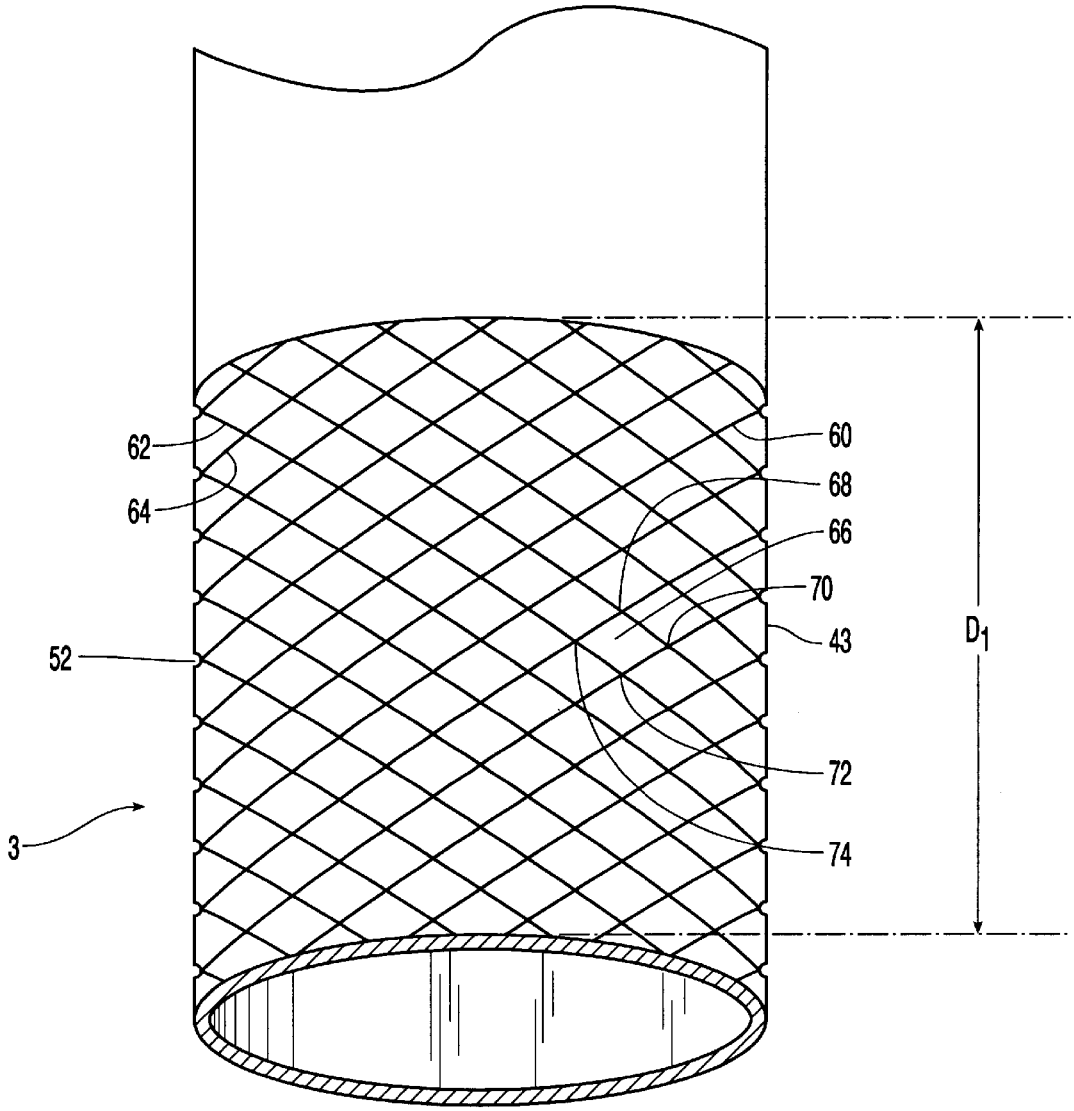
FIG. 21 is a perspective view of a shaft of another separate embodiment of the present invention.

FIG. 21 shows yet another embodiment to increase the surface area on the outer surface 43 of the shaft 3. The shaft 3 is used in a similar manner as shown in FIGS. 12 and 19, except that the shaft 3 includes grooves 60 similar to those shown in FIG. 16 to increase the surface area for bonding. There are two sets 62, 64 of diagonal grooves 60 that are substantially perpendicular to one another, thus forming diamond shapes 66 between their intersections 68, 70, 72, 74. This pattern is formed on the end 52 of the shaft 3 by placing the shaft 3 on a lathe with a cylinder placed inside the end 52 of the shaft 3 for support so that the shaft 3 will not deform. The end of the shaft 3 is then knurled with grooves 60. This increases surface area and assists in providing a high integrity adhesive bond 12 between the outer surface 43 of the shaft 3 and the inner surface 44 of the bore 6.

Any of the forgoing embodiments of the present invention to increase the bonded surface area may be used in combination with each other, thus providing an even more secure attachment between the shaft 3 and the putter head 2. Further, increased bond area on the surface of the connection pin 9 may be adapted for use in any of the embodiments of the present invention. The increased surface area strengthens the adhesive bond 12 between the inner surface 50 of the shaft 3 and the outer surface 24 of the connection pin 9 thus making it more difficult for the shaft 3 to separate from the putter head 2.

Furthermore, any of these embodiments to increase surface area may be used with any of the other embodiments previously described for the putter head 2, shaft 3, and connection pin 9. Specifically, in FIGS. 7–11, different embodiments for attaching the connection pin 9 to the putter head 2 are shown. Any of these embodiments and others may be used in combination with any of the above described embodiments for increasing the bonded surface area to produce a high integrity bond.

For example, as shown in FIG. 11 the mechanical connection 11 is a weld between the connection pin 9 and the bottom surface of the bore 6. The connection pin 9 could have an increased surface area covering the entire length L of the connection pin 9. The increased surface area could be accomplished through any of the above discussed embodiments including depressions 26, protrusions 28, grooves 30, or dimples 32 in the surface 24 of the connection pin 9.

Further, increased surface area could also be added to either or both the bore 6 or shaft 3.

While it is apparent that the invention herein disclosed is well calculated to fulfill the objectives stated above, it will be appreciated that numerous modifications and embodiments may be devised by those skilled in the art and it is intended that the appended claims cover such modifications and embodiments as fall within the spirit and scope of the present invention.

I claim:

1. A putter comprising;

a. a putter head having a putter face, a crown surface and a bore in the crown surface;

b. a connection pin secured to the bore of the putter;

c. a hollow shaft having an end received in the bore in surrounding relation with the connection pin and adhesively secured to at least the connection pin to create an adhesive bond between the shaft and the connection pin;

d. the connection pin having an outer surface; and e. the outer surface having a non-linear contour to increase the adhesive bond area and strength between the connection pin and the shaft.

2. The putter of claim 1 wherein the non-linear contour includes at least one depression on the outer surface of the connection pin.

3. The putter of claim 1 wherein the non-linear contour includes at least one protrusion extending from the outer surface of the connection pin.

4. The putter of claim 1 wherein the non-linear contour is located radially inwardly of the shaft.

5. The putter of claim 4 wherein the bore has a first and a second section, and a portion of the connection pin adjacent to the second section of the bore is serrated to thread the connection pin into the second section of the bore.

6. The putter of claim 5 wherein a portion of the connection pin is serrated so that at least half of the adhesive bond is adjacent to the serrated portion of the connection pin.

7. The putter of claim 5 wherein the serrations have a width and a depth, the width of the serrations being at least equal to the depth of the serrations.

8. The putter of claim 2 wherein the connection pin has a length and the depressions extend in relation to a center axis of the shaft to substantially cover the length of the connection pin.

9. The putter of claim 2 wherein the depressions extend in a relation perpendicular to a center axis of the shaft.

10. The putter of claim 2 wherein the depressions extend in a relation diagonal to a center axis of the shaft.

11. The putter of claim 2 wherein the depressions are cylindrical.

12. The putter of claim 2 wherein the depressions are grooves.

13. The putter of claim 12 wherein at least a portion of the grooves are parallel to one another.

14. The putter of claim 13 wherein the outer surface of the connection pin includes a first and a second set of parallel grooves, the grooves of the first set being substantially perpendicular to the grooves of the second set, whereby the two sets meet at a plurality of intersections to form a plurality of diamond shapes on the outer surface of the connection pin.

15. The putter of claim 2 wherein the depressions are a plurality of dimples forming indentations in the outer surface of the connection pin.

16. A putter comprising:

a. a putter head having a putter face, a crown surface and a bore in the crown surface;

b. a connection pin secured to the bore of the putter;

c. a hollow shaft having an end received in the bore in surrounding relation with the connection pin and adhesively secured to the connection pin and the bore to create an adhesive bond between the shaft and the connection pin and between the shaft and the bore; and d. the bore including a surface having a non-linear contour to increase the adhesive bond area and strength between the shaft and the bore.

17. The putter of claim 16 wherein the non-linear contour includes an inner surface of the bore with a plurality of grooves on a portion of the inner surface of the bore.

18. The putter of claim 17 wherein the bore has a length and the grooves extend in relation to a center axis of the shaft to substantially cover the length of the bore.

19. The putter of claim 16 wherein the bore includes a first and a second section, the first section including a non-linear contour.

20. The putter of claim 19 wherein a portion of the first section of the bore is threaded.

21. The putter of claim 20 wherein the thread forms a series of deep grooves on the inner surface of the bore.

22. The putter of claim 20 wherein the thread forms a series of shallow grooves on the inner surface of the bore.

23. The putter of claim 19 wherein the second section of the bore is threaded to receive the connection pin.

24. A putter comprising:

a. a putter head having a putter face, a crown surface and a bore in the crown surface;

b. a connection pin secured to the bore of the putter;

c. a hollow shaft having an end received in the bore in surrounding relation with the connection pin bore and adhesively secured to at least the connection pin to create an adhesive bond between the shaft and the connection pin; and d. the shaft including a surface having a non-linear contour to increase the adhesive bond area and strength between the shaft and the connection pin and the shaft and the bore.

25. The putter of claim 24 wherein the shaft is crimped on a portion adjacent the connection pin.

26. The putter of claim 24 wherein the shaft has an inner surface adjacent to the connection pin, the inner surface including a non-linear contour to increase the adhesive bond area and strength between the shaft and the connection pin.

27. The putter of claim 25 wherein the shaft has an outer surface wherein the non-linear contour includes a plurality of depressions on the outer surface of the shaft adjacent the bore.

28. The putter of claim 27 wherein the shaft is threaded on a portion of the outer surface adjacent the bore.

29. The putter of claim 27 wherein at least a portion of the outer surface of the shaft has a plurality of grooves.

30. The putter of claim 29 wherein at least a portion of the grooves are parallel to one another.

31. The putter of claim 30 wherein the outer surface of the shaft includes a first and a second set of parallel grooves the grooves of the first set being substantially perpendicular to the grooves of the second set, whereby the two sets meet at a plurality of intersections to form a plurality of diamond shapes on the outer surface of the shaft.

32. A putter comprising:

a. a putter head having a putter face, a crown surface and a bore in the crown surface;

b. a connection pin secured to the bore of the putter;

c. a hollow shaft having an end received in the bore in surrounding relation with the connection pin and adhesively secured to at least the connection pin to create an adhesive bond between the shaft and the connection pin; and d. the bore, connection pin and shaft include a non-linear contour to increase the adhesive bond area and strength between the shaft and the connection, the shaft and the bore, and the bore and the connection pin.

* * * * *